US009719478B2

(12) United States Patent
Nicolas et al.

(10) Patent No.: US 9,719,478 B2
(45) Date of Patent: Aug. 1, 2017

(54) STARTER DEVICE FOR AN INTERNAL COMBUSTION ENGINE

(71) Applicant: VOLVO TRUCK CORPORATION, Göteborg (SE)

(72) Inventors: Romain Nicolas, Lyons (FR); Yann Boete, Lyons (FR)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 14/898,820

(22) PCT Filed: Jul. 19, 2013

(86) PCT No.: PCT/IB2013/002039
§ 371 (c)(1),
(2) Date: Dec. 16, 2015

(87) PCT Pub. No.: WO2015/008105
PCT Pub. Date: Jan. 22, 2015

(65) Prior Publication Data

US 2016/0131099 A1 May 12, 2016

(51) Int. Cl.
*F02N 15/06* (2006.01)
*F02N 11/02* (2006.01)

(52) U.S. Cl.
CPC ..... *F02N 15/06* (2013.01); *F02N 11/02* (2013.01); *F02N 15/066* (2013.01)

(58) Field of Classification Search
CPC ..... F02N 11/02; F02N 15/02; F02N 15/06; F02N 15/066
(Continued)

(56) References Cited

U.S. PATENT DOCUMENTS 2,342,632 A 5/1942 Hood
3,572,133 A * 3/1971 Giometti ..... F02N 15/066 290/38 R
(Continued)

FOREIGN PATENT DOCUMENTS

EP 2615332 A1 7/2013
FR 2686688 A1 12/2006
(Continued)

OTHER PUBLICATIONS

Japanese Official Action (Oct. 26, 2016) (translation) for corresponding Japanese App. 2016-526710.
(Continued)

*Primary Examiner* — John Kwon
*Assistant Examiner* — Johnny H Hoang
(74) *Attorney, Agent, or Firm* — WRB-IP LLP

(57) ABSTRACT

A starter device for an internal combustion engine includes a starter housing, an electric motor and an engagement pinion driven in rotation by the motor around the pinion rotation axis, the pinion being movable in a translational motion along its pinion rotation axis between a retracted position and an engaging position for engaging a gear connected to the internal combustion engine, the translational motion being caused by the rotation of the electric motor, the starter device further comprising a non-rotatable element which is blocked in rotation with respect to the starter housing, a rotatable element driven in rotation by the electric motor, a helical linkage between the non rotatable element and the rotatable element for causing the translational motion of the pinion. The non rotatable element is fixed in translation along the pinion rotation axis with respect to the starter housing, the rotatable element can translate with respect to the starter housing, and translation of the rotatable element causes translation of the pinion
(Continued)

towards its engaging position. The non-rotatable element includes a retractable clutching member with a pin movable in translational movement, so that the helical linkage can be deactivated.

16 Claims, 3 Drawing Sheets

(58) Field of Classification Search
USPC ..... 123/179.1, 179.25, 185.1, 185.11; 290/38 R, 48
See application file for complete search history.

(56) References Cited

U.S. PATENT DOCUMENTS

| | | | | |
|---|---|---|---|---|
| 3,599,496 | A * | 8/1971 | Toulier | F02N 15/003 74/7 R |
| 3,875,805 | A * | 4/1975 | Toulier | F02N 11/00 192/114 R |
| 8,196,558 | B2 * | 6/2012 | Okumoto | F02N 11/0844 123/179.25 |
| 2014/0326106 | A1 | 11/2014 | Ikemori et al. | |

FOREIGN PATENT DOCUMENTS

| | | |
|---|---|---|
| JP | 2007146759 | 6/2007 |
| JP | 2013137014 | 7/2013 |

OTHER PUBLICATIONS

Internationa Search Report Apr. 9, 2014 for corresponding International App. PCT/IB2013/002039.

* cited by examiner

STARTER DEVICE FOR AN INTERNAL COMBUSTION ENGINE

BACKGROUND AND SUMMARY

The invention relates to a starter device for aft internal combustion engine.

Automotive vehicles, such as tracks, are often equipped with a starter device which drives the internal combustion engine of the vehicle during a starting phase. The starter device includes a pinion which selectively engages a gear connected to the internal combustion engine, e.g. a ring mounted on the flywheel of the engine. The starter device is used only during some sequences and the starting rotation speed may be inferior to the nominal engine rotation speed. To protect the starter motor, which is generally electrically driven, from damages provoked by overspeed and wear, the pinion is engaged with the ring gear only during the starting phase. The starter device therefore comprises an actuation system which engages or disengages the pinion with the ring gear. The actuation system also needs to operate the electrical connection of the starter motor to a power supply of the vehicle.

Known actuation systems comprise an electrical solenoid which moves a plunger linked to a mechanical coupler and an electrical contactor. When electrical current is provided to the solenoid, the subsequent movement of the plunger causes the mechanical coupler to engage the pinion with the ring gear. The electrical contactor then closes an electrical circuit which feeds the starter motor, so that it delivers torque to the internal combustion engine.

The use of such a solenoid implies major drawbacks. This solenoid is made of a significant amount of copper, which is a costly material. As it must generate a relatively long displacement, the volume of the solenoid is significant. The solenoid is therefore relatively heavy and difficult to package within the internal combustion engine arrangement.

To solve this issue, it is known, for example from FR-A-2 886 688, to engage the pinion with the ring gear by using the rotation of the starter motor to cause, the translation of the pinion. A member is engaged to a helical groove of a shaft driven by the starter motor, achieving a helical linkage which drives in translational motion a part which pushes the pinion toward the tins sear.

Such a technique involves a relatively high number of parts including an intermediate part which axially pushes the pinion. Moreover, this intermediate part is also involved in the helical linkage and roust therefore be blocked in rotation, involving additional blocking means and means to permit relative rotation between the pinion and the intermediate part. The starter is therefore complex to assemble.

It is desirable to provide a new starter device in which the helical linkage which produces the translation of the pinion involves fewer parts and works in a less complex way than in the prior art.

An aspect of the invention concerns a starter device for an internal combustion engine, said starter device comprising a starter housing, an electric motor and an engagement pinion driven in rotation by said motor around the pinion rotation axis, the pinion being movable in a translational motion along its pinion rotation axis between a retracted position and an engaging position for engaging a gear connected to the internal combustion engine, the translational motion being caused by the rotation of the electric motor, the starter device further comprising a non-rotatable element which is blocked in rotation with respect to the starter housing, a rotatable element driven in rotation by the electric motor, and a helical linkage between the non-rotatable element and the rotatable element for causing the translational motion of the pinion. This starter device is characterized in that the non-rotatable element is fixed in translation along the pinion rotation axis with respect to the starter housing in that the rotatable element can translate with respect to the starter housing, and in that translation of the rotatable element causes translation of the pinion towards its engaging position.

Thanks to an aspect of the invention, the non-rotatable element of the helical linkage is fixed in translation, instead of being movable in translation to engage the pinion with the flywheel ring. The translation is therefore directly transmitted to the rotatable element, avoiding the use of means to allow relative rotation between the pinion and the rotatable element.

According to further aspects of the invention which are advantageous but not compulsory, such a starter device may incorporate one or several of the following features:

- The helical linkage can be deactivated. This permits to more easily return the pinion to its non-engaging position, without needing to reverse the rotation direction of the starter motor.
- The non-rotatable element may comprise a retractable clutching member mounted in the starter housing. The retractable clutching member may be movable between a first deactivated position and an activated position with respect to the starter housing. A helical groove may be provided on an outer surface of the rotatable. The retractable clutching member may be engaged in the helical groove when the retractable clutching member is in its activated position.
- The rotatable element may comprise a transmission shaft driven by the electric motor and movable in translational movement with respect to the housing, between a first position, in which the pinion is in its non-engaging position, and a second position, in which the pinion can be in its engaging position.
- The starter device may comprise a resilient element adapted to urge the transmission shaft towards its first position. This permits to pull back the pinion towards its non-engaging position automatically, without using positive power from the motor for example.
- The helical linkage may be deactivated by retracting the retractable clutching member from the helical groove.
- An end of the helical groove may open in a peripheral groove, radial to a rotation axis of the rotatable member, in which the retractable clutching member may be received when the pinion is completely engaged with the ring gear. This permits to allow rotation of the pinion without inducing translation of the pinion, without necessarily deactivating the clutching member.
- The retractable clutching member can be movable between its first deactivated position and its activated position along a translational movement along a transversal axis.
- The retractable clutching member may be movable from its first deactivated position, to a second position where its clutching portion is hi contact with the outer surface of the rotatable element, to a third position where its clutching portion is received in the helical groove and to a fourth position where its clutching portion is received in the peripheral groove. One advantage of this feature is that, by detecting the position retractable clutching member, it can possible to determine in which state the starter is.

The starter device may comprise a resilient element which urges the retractable clutching member towards its deactivated position.

The feeding of the starter motor with electrical current may be controlled by the movement of the retractable clutching member.

The retractable clutching member may comprise a main contact plate adapted to close a high power circuit for the starter motor (M), for example by making a contact with a first and a second connecting tabs in order to allow nominal power in the starter motor, when the retractable clutching member is in the groove radial to the rotation axis of the pinion, so as to drive the starter motor at a nominal torque or rotation speed. In other words, the main contact plate closes a high power circuit for the starter motor.

The retractable clutching member may comprise a preliminary contact plate adapted to close a low power circuit, for example by making a contact with a third and a fourth connecting tabs in order to allow reduced power in the starter motor, when the retractable clutching member is in the helical groove, so as to drive the starter motor at a low torque or rotation speed. In other words, the preliminary contact plate closes a low power circuit for the starter motor. The depth of the helical groove may be inferior to the depth of the peripheral groove. This permits to engage the pinion with minimal potential damages.

In the deactivated position of the retractable clutching member, the main and preliminary contact plates and the connecting tabs may be located so that, during the movement of the retractable clutching member towards the helical groove, the contact between the preliminary contact plate and the third and fourth connecting tabs is made before the contact between the main contact plate and the first and second connecting tabs. Thereby, the preliminary contact plate closes the low power circuit before the main contact plate closes the high power circuit.

The preliminary contact plate may close the low power circuit, for example by connecting the third and fourth connecting tabs, when the retractable clutching member is in its second and third positions and the main contact plate may close the high power circuit, for example by connecting the first and second connecting tabs, when the retractable clutching member is in its fourth position.

The main and preliminary contact plates may be movable in translation with respect to the retractable clutching member along a longitudinal axis of the retractable clutching member.

The electrical contact between the preliminary contact plate and the third and fourth connecting tabs may be kept, thereby keeping the low power circuit closed, by a resilient element mounted between the main contact plate and the preliminary contact plate, and the electrical contact between the main contact plate and the first and second connecting tabs may be kept, thereby keeping the high power circuit closed, by a resilient element mounted between the first contact plate and a collar of the retractable clutching member.

The pinion may be movable hi translational movement with respect to the rotatable element, and wherein a resilient element urges the pinion towards an end of the rotatable element located on the side of the ring gear. In case of a tooth-against-tooth situation, this permits to effectively engage the pinion by allowing it to rotate in the right angular position.

BRIEF DESCRIPTION OF THE DRAWINGS

The invention will now be explained in reference to the annexed figures, as an illustrative example. In the annexed figures.

DETAILED DESCRIPTION

Figure 1:
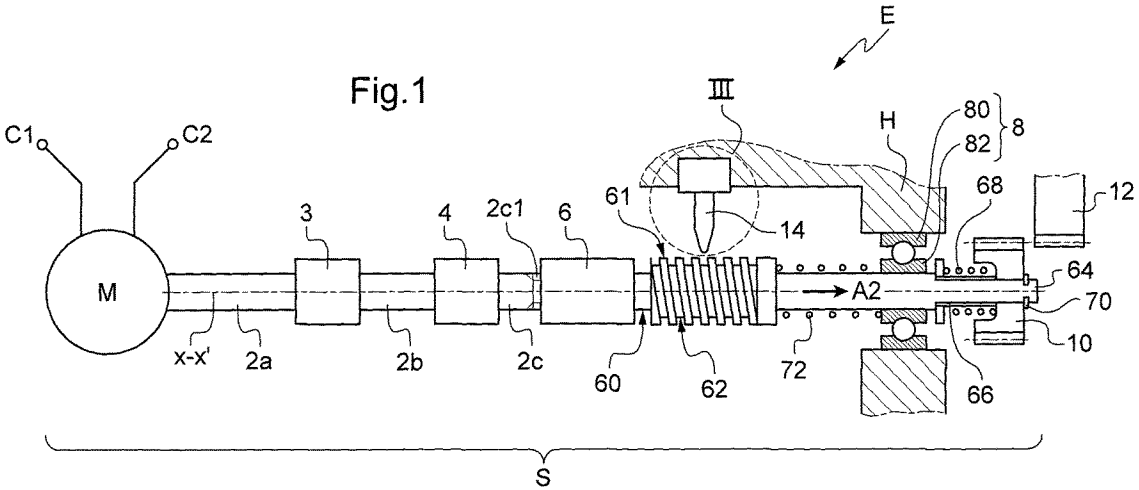
FIG. 1 is a schematic view of starter device according to the invention, in a first configuration.
Figure 2:
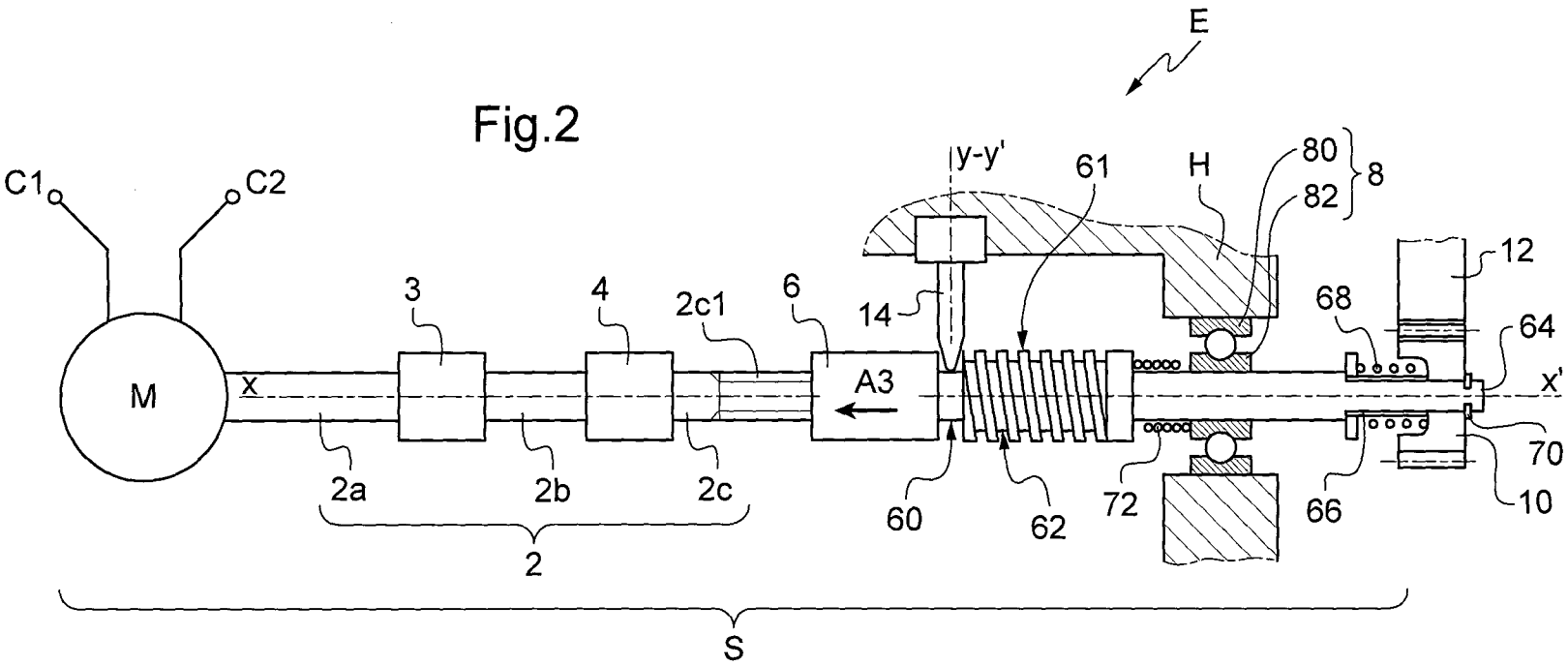
FIG. 2 is a schematic view of the starter device of FIG. 1, in a second configuration.
Figure 3:
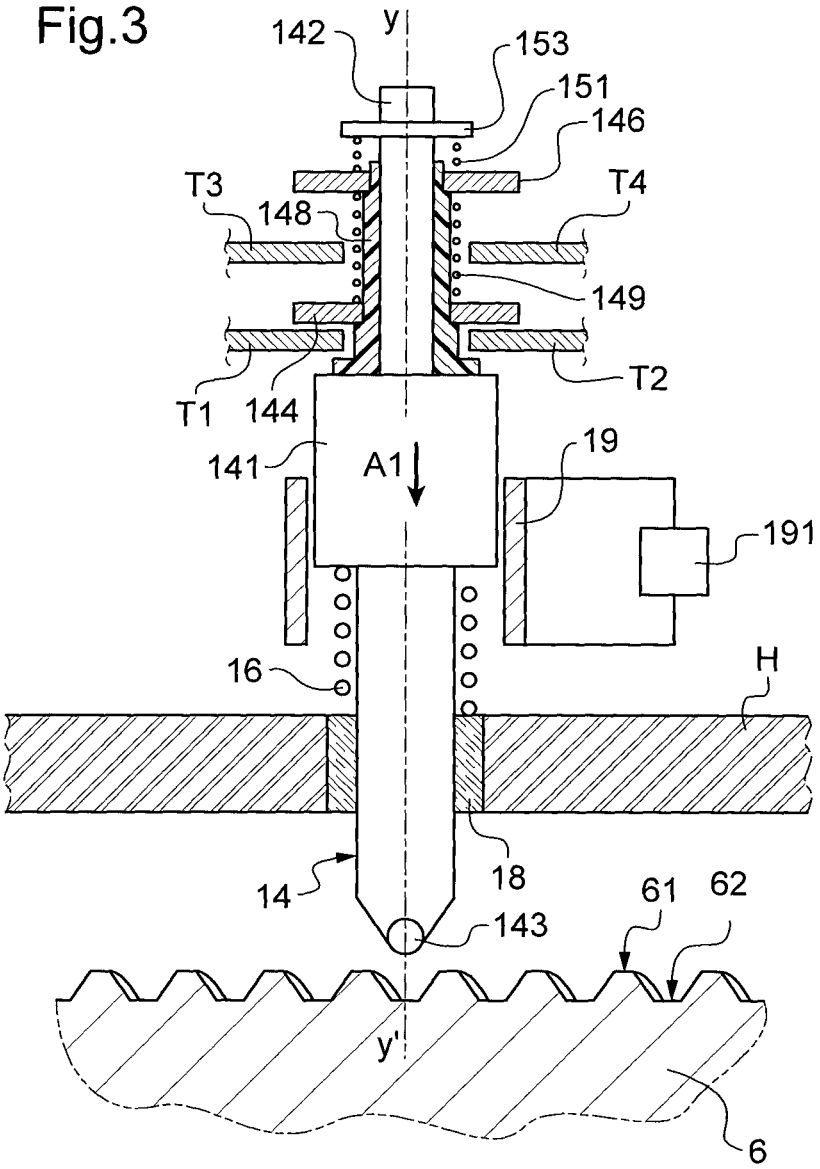
FIG. 3 is a schematic view, at a larger scale, of detail III on FIG. 1.

As represented on FIGS. 1 to 3, a starter device D for an internal combustion engine comprises a starter motor M and an actuation system S which permits to cause the engagement of a pinion 10 of the starter device with a ring gear 12 of the internal combustion engine. Pinion 10 is driven by starter motor M. In some embodiments, starter motor M may be connected either through a first low power electrical circuit C, in order to deliver reduced power and to obtain a low toque or rotation speed, for engaging pinion 10 with ring gear 12, or through a second high power circuit C2, in order to deliver a nominal power to obtain a nominal torque or rotation speed of motor M, for starting the internal combustion engine. Electrical, circuits C1 and C2 may respectively comprise a low power set of coils and a high power set of coils in the motor, and/or may comprise low and high power sources of electrical current. The electrical current may be delivered by a battery set of an automotive vehicle, such as a truck, on which the internal combustion engine and starter device D may be integrated.

According to a non-shown embodiment of the invention, starter motor M may controlled only at high power, and pinion 10 may be engaged with ring gear 12 directly at the nominal torque or rotation speed of starter motor M.

Starter motor M may comprise an output shaft 2 rotating around a rotation axis X-X', which is a longitudinal axis of output shaft 2. In this embodiment, axis X-X' forms the rotation axis of pinion 10. In this embodiment, output shaft 2 may be divided into three sections 2*a*, 2*b* and 2*c*. First section 2*a* is directly driven by starter motor M. Second section 2*b* is coupled in rotation to first section 2*a* via an optional reduction gear 3. Third section 2*e* is coupled in rotation to second section 2*b* via a one-way clutch 4. One-way clutch 4 operates so that, second section 2*b* can drive third section 2*c* only in one direction, while third section 2*c* cannot drive second section 2*b* along that direction. This means third section 2*c* can rotate at a higher rotation speed than second section 2*b*.

The translational motion of pinion 10 towards ring gear 12 from a retracted position, towards an engaging position is caused by the rotation of starter motor M. The rotational motion of starter motor M is transformed into a translation motion by means of a helical linkage between a rotatable element, which is driven in rotation by starter motor M by being coupled in rotation with output shaft 2, and a non-rotatable element with respect to which the rotatable element rotates and which is blocked in rotation, around the rotation axis of the rotatable element with respect to a housing H of starter device D.

The non-rotatable element is fixed in translation with respect to housing H along axis X-X', while the rotatable element can translate with respect to housing H along axis X-X'. Translation of the rotatable element causes translation of pinion 10 towards its engaging position. The rotatable element is coupled in rotation to the pinion, so that rotation of the pinion 10 element is directly linked to the rotation of the rotatable element.

The rotatable element may be a transmission shaft 6. Transmission shaft 6 may be coupled in rotation with output shaft 2 via its third section 2*c* thanks to splines 2*cl*. Indeed, the end of third section 2*c* which is opposed to one-way clutch 4 may comprise rectilinear splines 2*cl*. The splines 2*ca* of the output shaft may cooperate with non-shown rectilinear splines of transmission shaft 6. Splines 2*cl* allow translation of transmission shaft 6 with respect to the housing H. In this embodiment, output shaft 2 and transmission shaft 6 extend along the same axis, i.e. rotation axis X-X'. However, they could be arranged along two parallel but distinct axes.

Pinion 10 is mounted on an end 64 of transmission shaft 6 opposed to third section 2*c*. Pinion 10 is coupled in rotation with the transmission shaft, for example via respective mating splines on the pinion and on the end 64 of the transmission shaft. Transmission shaft 6 is movable in translation along axis X-X' with respect to output shaft 2 between a first position, represented on FIG. 1, in which pinion 10 is not engaged with ring gear 12, and a second position represented on FIG. 2, in which pinion 10 can be fully engaged with ring gear 12 (although it will be described further that further means may be provided to allow the transmission shaft to reach its second position even if the pinion is blocked before its engaging position by the ring gear). Transmission shaft 6 is preferably urged towards its first position by a resilient element, such as a spring 72.

The rotation of transmission shaft 6 may be allowed by a rolling bearing 8 mounted between transmission shaft 6 and housing H starter device D. An outer ring 80 of rolling bearing 8 is coupled in rotation to housing H, while an inner ring 82 of rolling bearing 8 is coupled in rotation to transmission shaft 6. Transmission shaft 6 is free to move along axis X-X' with respect to inner ring 82 thanks to non-shown sliding means, such as splines, of via a plain bearing.

In the shown embodiment, the non-rotatable element involved in the helical linkage is a controlled retractable clutching member, which can for example be electrically controlled. In this embodiment, the retractable clutching member comprises a pin 14, which is movable in translational movement with respect to housing H along a transversal axis Y-Y' which may be perpendicular to axis X-X' and which forms a longitudinal axis of pin 14. The translational movement of pin 14 with respect to housing H may be allowed by a bearing ring 18, which is mounted in a hole of housing H represented on FIG. 3.

Alternatively, in a non-represented embodiment, the retractable clutching member may be movable in rotational movement with respect to housing H, for example around an axis perpendicular to axis X-X', and may comprise a radially extending member for activating the helical linkage.

Transmission shaft 6 comprises a peripheral groove 60 which is radial to axis X-X'. Transmission shaft 6 also comprises a peripheral helical groove 62 which is adjacent to peripheral groove 60. An end of helical groove 62 opens in groove 60. Grooves 60 and 62 are realized in an outer surface 61 of transmission shaft 6.

The retractable clutching member comprises a clutching portion able to engage the grooves, so as to form a fixed abutment for the groove along the direction of translation of the rotatable member when if is engaged. The clutching portion is compatible in shape with the grooves inasmuch as is must be received in the grooves without blocking the rotation of the rotating member. In the case of a retractable clutching member in the form of a pin, as in the shown embodiment, the tip of the pin forms a clutching portion of the retractable clutching member. However, the clutching portion could exhibit other shapes, such as a shape complementary to that of the helical groove, for example in the form of sector of a helical tooth so as to increase the contact surface between the helical grove and the clutching portion.

Pin 14 is spring biased towards a retracted position, represented on FIGS. 1 and 3, by a spring 16. In its retracted position, pin 14 is remote from transmission shaft 6, so that the helical linkage is deactivated.

Pin 14 comprises a central portion 141 which is made of a metallic magnetic material. Central portion 141 is mounted radially within a solenoid 19 which surrounds central portion 141. Solenoid 19 is electrically connected to the battery set of the vehicle, via a controller 191 adapted to activate or deactivate the passage of electrical current in solenoid 19. Passage of current in solenoid 19 urges pin 14 towards helical groove 62, against the action of spring 16.

When the tip of pin 14, which may be formed by a ball 143, is received in helical groove 62 the helical linkage between pin 14 and transmission shaft 6 is activated and causes a translational movement of transmission, shaft 6 along axis X-X', towards ring gear 12, when motor M drives output shaft 2. Ball 143 allows relative rotation between transmission shaft 6 and pin 14 and limits friction in between.

In the shown embodiment, feeding of starter motor M with electrical current is controlled by the motion of the retractable clutching member. In this embodiment, the feeding of starter motor M is controlled by the translational motion of pin 14. As represented on FIG. 3 only, pin 14 comprises, on a side of central portion 141 opposite to axis X-X', a rod 142 which extends along axis Y-Y'. Around rod 142 and perpendicularly to axis Y-Y', pin 14 comprises two contact plates 144 and 146, each made of an electrically conducting material. A main contact plate 146 is located further away from central portion 141 than a preliminary contact plate 144. Contact plates 144 and 146 are respectively adapted to close some electrical circuits C1 and C2 corresponding to low power and high power circuits for the starter motor M.

An insulating sleeve 148 is mounted between, rod 142 and contact plates 144 and 146, so that no electrical contact can take place between contact plates 144 and 146 and rod 142, or between contact plates 144 and 146 themselves. Contact plates 146 and 144 are mounted around insulating sleeve 148, so that they can move in translational movement along axis Y-Y' with respect to rod 142 of pin 14. As can be seen on FIG. 3, the sleeve 148 has two abutment surfaces which define the rest positions of the plates 144, 146. As shown on FIG. 3, these abutment surfaces may be formed by annular surfaces of the sleeve formed by three consecutive portions of decreasing diameters of the sleeve 148. Each abutment surface is formed at the limit between two consecutive portions of different diameter of the sleeve. The abutment surfaces are turned away from the transmission shaft 6. The abutment surfaces could also be formed by elastic rings mounted in corresponding annular grooves formed in the exterior surface of the sleeve.

A first spring 149 is mounted around insulating sleeve 148 between the preliminary contact plate 144 and the main contact plate 146. Spring 149 tends to move contact plate 144 away from contact plate 146, towers the helical groove and, in the rest position of FIG. 3, it presses the preliminary contact 144 plate against the corresponding abutment surface of the sleeve.

A second spring 151 is mounted around insulating sleeve 148 between contact plate 146 and a collar 153 which is fixed on rod 142 and extends radially from rod 142 at the end of rod 142 located opposite from central portion 141. Spring 151 tends to move contact plate 146 away from collar 153, towards the transmission shaft. In the rest position of FIG. 3, the spring 151 presses the main contact plate 146 against the corresponding abutment surface of the sleeve.

The stiffness of spring 151 may be superior to the stiffness of spring 149 so that, at the rest position, the two contact plates 144 and 146 are pressed against their corresponding abutment surfaces.

In order to prevent any electrical contact between contact plates 144 and 146 and springs 149 and 151, the portions of contact plates 144 and 146 on which springs 149 and 151 are mounted comprise a layer of insulating material, which is not represented on the figures for the sake of clarity.

In case pinion 10 is engaged directly at the nominal torque or rotation speed of starter motor M, pin 14 only comprises one contact plate 146 for closing the high power electrical circuit C2 so that the motor M delivers directly its nominal torque or speed.

Actuation system S works in the following way: actuation pin 14 is initially retracted in its position of FIGS. 1 and 3, away from the transmission shaft 6, under the action of spring 16. In this position, the contact plates 144 and 146 are in their respective rest position and do not contact the tabs T1 to T4, so that both circuits C1 and C2 are open. The starter motor M is at standstill. When the internal combustion engine must be started, a starting signal is transmitted to controller 191 so that electrical current passes in solenoid 19. This causes pin 14 to move towards axis X-X', i.e. towards the transmission shaft 6, as represented by arrow A1 on FIG. 3. Because of the movement of pin 14 along axis Y-Y', preliminary contact plate 144 contacts a fixed connecting tab T1 of actuation system S. Preliminary contact plate 144 also contacts a fixed connecting tab T2 which is electrically connected to motor M. Connecting tabs T1 and T2 correspond to the low power circuit C1. Thus, the contact between preliminary contact plate 144 and connecting tabs T1 and T2 allows passage of electrical current towards starter motor, which begins to rotate at a low torque or rotation speed. Once preliminary contact plate 144 is in contact with connecting tabs T1 and T2, preliminary contact plate 144 is kept in contact against connecting tabs T1 and T2 by spring 149, but allows further movement of the pin 14.

During its translational motion along arrow A1, pin 14 may enter in contact with outer surface 61. As starter motor has begun to rotate under the action of low power circuit C1, helical groove 62 rotates together with transmission shaft 6. As pin 14 is permanently pushed towards axis Y-Y', helical groove 62 rotates until ball 143 of pin 14 enters helical groove 62 so that the pin is then engaged in the helical groove. Because of the helical shape of groove 62, the cooperation of helical groove 62 and pin 14 causes transmission shaft 6 to move along axis X-X' towards ring gear 12, as represented by arrow A2 on FIG. 1. During this translational movement, pinion 10 comes closer to ring gear 12 until the teeth of pinion 10 and the teeth of ring gear 12 engage with each other.

As long as the tip of pin 14 formed by ball 143 lies within helical groove 62, the movement of pin 14 in the direction of arrow A1 is limited by the fact that ball 143 abuts against the bottom of helical groove 62.

When pinion 10 and ring gear 12 are properly engaged as represented on FIG. 2, the transmission shaft has translated along its axis to such an extent that the ball of the pin has travelled the full length of the helical groove 62 and now faces the peripheral groove 60. Therefore, the ball 143 of pin 14 gets into peripheral groove 60, at the end of helical groove 62. The depth of groove 60 is superior to the depth of helical groove 62. As pin 14 is still pushed along axis Y-Y' by solenoid 19, pin 14 moves farther towards axis X-X' until it reaches a position in which main contact plate 146 comes in contact with a fixed connecting tab T3 of actuation system S and with a connecting tab T4 which is electrically connected to starter motor M, the connecting tabs T3 and T4 corresponding to high power circuit C2. The contact between connecting tabs T3 and T4 and main contact plate 146 closes the high power electrical circuit C2 which allows the starter-motor M to deliver high power or rotation speed. Starter motor M therefore begins to drive output shaft 2 at its nominal rotation speed, in order to transmit starting torque to gear ring 12 and start the internal combustion engine. During the starting operation, main contact plate 146 is kept in contact with connecting tabs T3 and T4 by spring 151.

To guarantee that the force exerted by spring 149 does not cause main contact plate 146 from losing contact with connecting tabs T3 and T4, the stiffness of spring 151 may be chosen superior to the stiffness of spring 149 in such a way that the effort of spring 149 on main contact plate 146 is lower than the effort of spring 151 on main contact plate.

In order to guarantee that the engagement between pinion 10 and ring gear 12 works properly, pinion 10 should preferably first be rotated at a low rotation speed. To this end, starter motor M should preferably be operated at low power, to deliver low torque and rotation speed, until the pinion is properly engaged on the ring gear, before being operated at its nominal power, for delivering its nominal torque or rotation speed. In the retracted position of pin 14, contact plates 144 and 146 and connecting tabs T1 to T4 are positioned with respect to each other so that, when the movement of pin 14 along arrow A1 begins, contact is first made between connecting tabs T1 and T2 and contact plate 144. The contact between connecting tabs T3 and T4 and contact plate 146 is not made until ball 143 of pin 14 reaches peripheral groove 60.

In case pinion 10 is directly engaged with ring gear 12 at the nominal torque or rotation speed of motor M, starter device D only comprises connecting tabs T3 and T4, and the depth of helical groove 62 may be equal to the depth of groove 60.

When pin 14 reaches groove 60, a sensor may generate a signal which warns the driver of the vehicle that pinion 10 has been properly engaged with ring gear 12. Such sensor can be in fact the controller 191 is said controller can determine the position of pin 14 along its axis Y-Y'.

In case the teeth of pinion 10 and ring gear 12 are aligned along the same axis, pinion 10 and ring gear 12 cannot engage with each other properly, because the teeth of ring gear 12 block the translational movement of pinion 10 in the direction of arrow A2. Pinion 10 is therefore mounted on transmission shaft 6 so that pinion 10 is movable, along axis X-X', with respect to end 64. Transmission shaft 6 comprises rectilinear splines 66 which cooperate with non-shown inner rectilinear splines of pinion 0.

The translational movement of pinion 10 with respect to transmission shaft 6 opposite to end 64 is limited by a resilient element, such as a spring 68, which urges pinion 10 towards end 64. The translational movement of pinion 10 towards end 64 is blocked by an elastic ring 70.

Thanks to the relative translational movement possibility between pinion 10 and transmission shaft 6, the translational movement of transmission shaft 6 in the direction of arrow A2 goes on, even if pinion 0 and ring gear 12 are in a tooth-against-tooth situation.

Pinion 10 is therefore moved away from elastic ring 70 along axis X-X' in the opposite direction to arrow A2, against the action of spring 66, because of the resistance of ring gear 12. As transmission shaft 6 goes on rotating around axis X-X', pinion 10 also rotates with respect to ring gear 12 and the teeth of pinion 10 and ring gear 12 become angularly offset, so that pinion 10 and ring gear 12 can properly engage with each other. At this moment, under the action of spring 66, pinion 10 is pushed back towards ring gear 12 and against elastic ring 70 until the teeth of pinion 10 and ring gear 12 are fully engaged with each other, as shown on FIG. 2.

When the internal combustion engine is properly started, pinion 10 begins to rotate at a rotation speed which is superior to the nominal rotation speed of starter motor M. Thanks to one-way clutch 4, transmission shaft 6 and third section 2*c* rotate at the rotation speed of the internal combustion engine, while first and second sections 2*a* and 2*b* continue to rotate at the nominal rotation speed of starter motor M. This prevents damages on starter motor M.

When starter motor must be switched-off, pinion 10 must be retracted from ring gear 12. A signal is emitted to controller 191, for example from an automated controller which watches the operation of the internal combustion engine, to stop passage of electrical current in solenoid 19. As pin 14 is no more driven along axis Y-Y' by solenoid 19, pin 14 is pushed back towards its retracted position of FIG. 3 by spring 16. Pin 14 does not block transmission shaft 6 in its position of FIG. 2 anymore, and transmission shaft 6 is then pushed back towards its position of FIG. 1 by spring 72, as shown by arrow A3 on FIG. 2. The retraction of pin 14 in its first position also suppresses the contacts between first contact plate 144 and connecting tabs T1 and T2 and between second contact plate 146 and connecting tabs T3 and T4. The rotation of starter motor M therefore stops.

According to a non-shown embodiment of the invention, the feeding of starter motor M with electrical current may be controlled by the position of transmission shaft 6 along axis X-X' instead of the position of pin 14 along axis Y-Y'.

The features of the above-described embodiments can be combined within the scope of the invention.

The invention claimed is:

1. Starter device for an internal combustion engine, the starter device comprising a starter housing, an electric motor and an engagement pinion driven in rotation by the motor around the pinion rotation axis, the pinion being movable in a translational motion along its pinion rotation axis between a retracted position and an engaging position for engaging a gear connected to the internal combustion engine, the translational motion being caused by the rotation of the electric motor, the starter device further comprising a non-rotatable element which is blocked in rotation with respect to the starter housing, a rotatable element driven in rotation by the electric motor, a helical linkage between the non-rotatable element and the rotatable element for causing the translational motion of the pinion, wherein the non-rotatable element is fixed in translation along the pinion rotation axis with respect to the starter housing, the rotatable element can translate with respect to the starter housing, and translation of the rotatable element causes translation of the pinion towards its engaging position, wherein the helical linkage is arranged to be deactivated, and wherein the non-rotatable element comprises a retractable clutching member mounted in the starter housing, wherein the retractable clutching member is movable between a first deactivated position and an activated position with respect to the starter housing, wherein an helical groove provided on an outer surface of the rotatable element, and wherein the retractable clutching member is engaged in the helical groove when the retractable clutching member is in its activated position.

2. Starter device according to claim 1, wherein the rotatable element comprises a transmission shaft driven by the electric motor and movable in translational movement with respect to the housing, between a first position, in which the pinion is in its non-engaging position, and a second position, in which the pinion can be in its engaging position.

3. Starter device according to claim 2, comprising a resilient element adapted to urge the transmission shaft towards its first position.

4. Starter device according to claim 1, wherein the helical linkage is deactivated by retracting the retractable clutching member from the helical groove.

5. Starter device according to claim 4, wherein the low power circuit is kept closed by a resilient element mounted between the preliminary contact plate and the main contact plate and the high power circuit is kept closed by a resilient element mounted between the main contact plate and a collar of the retractable clutching member.

6. Starter device according to claim 1, wherein an end of the helical groove opens in a peripheral groove radial to a rotation axis of the rotatable element in which the retractable clutching member is received when the pinion is completely engaged with the ring gear.

7. Starter device according to claim 6, wherein the retractable clutching member is movable from its first deactivated position, to a second position where its clutching portion is in contact with the outer surface of the rotatable element, to a third position where its clutching portion is received in the helical groove and to a fourth position where its clutching portion is received in the peripheral groove.

8. Starter device according to claim 7, wherein the retractable clutching member comprises a principal contact plate adapted to close a high power circuit for the starter motor when the retractable clutching member is in the groove radial to the rotation axis of the pinion, so as to drive the starter motor at a nominal torque or rotation speed, wherein the retractable clutching member comprises an preliminary contact plate adapted to close a low power circuit for the starter motor when the retractable clutching member is in the helical groove, so as to drive the starter motor at a low torque or rotation speed, and wherein the depth of the helical groove is inferior to the depth of the peripheral groove, wherein in the deactivated position of the retractable clutching member, the main and preliminary contact plates are located so that, during the movement of the retractable clutching member towards the helical groove, the preliminary contact plate closes the low power circuit before the main contact plate closes the high power circuit, and wherein the preliminary contact plate closes the low power circuit when the retractable clutching member is in its second and third positions and the main contact plate closes the high power circuit when the retractable clutching member is in its fourth position.

9. Starter device according to claim 6, wherein therein the retractable clutching member comprises a principal contact plate adapted to close a high power circuit for the starter motor when the retractable clutching member is in the groove radial to the rotation axis of the pinion, so as to drive the starter motor at a nominal torque or rotation speed, wherein the retractable clutching member comprises an preliminary contact plate adapted to close a low power circuit for the starter motor when the retractable clutching member is in the helical groove, so as to drive the starter motor at a low torque or rotation speed, and wherein the depth of the helical groove is inferior to the depth of the peripheral groove, and wherein in the deactivated position of the retractable clutching member, the main and preliminary contact plates are located so that, during the movement of the retractable clutching member towards the helical groove, the preliminary contact plate closes the low power circuit before the main contact plate closes the high power circuit.

10. Starter device according to claim 6, wherein it comprises a resilient element which urges the retractable clutching member towards its deactivated position.

11. Starter device according to claim 6, wherein the retractable clutching member comprises a principal contact plate adapted to close a high power circuit for the starter motor when the retractable clutching member is in the groove radial to the rotation axis of the pinion, so as to drive the starter motor at a nominal torque or rotation speed, and wherein the retractable clutching member comprises an preliminary contact plate adapted to close a low power circuit for the starter motor when the retractable clutching member is in the helical groove, so as to drive the starter motor at a low torque or rotation speed, and wherein the depth of the helical groove is inferior to the depth of the peripheral groove.

12. Starter device according to claim 11, wherein the main and preliminary contact plates are movable in translation with respect to the retractable clutching member along a longitudinal axis of the retractable clutching member.

13. Starter device according to claim 1, wherein the retractable clutching member is movable between its first deactivated position and its activated position along a translational movement along a transversal axis.

14. Starter device according to claim 1, wherein the feeding of the starter motor with electrical current is controlled by the movement of the retractable clutching member.

15. Starter device according to claim 14, wherein the retractable clutching member comprises a principal contact plate adapted to close a high power circuit for the starter motor when the retractable clutching member is in the groove radial to the rotation axis of the pinion, so as to drive the starter motor at a nominal torque or rotation speed.

16. Starter device according to claim 1, wherein the pinion is movable in translational movement with respect to the rotatable element, and wherein a resilient element urges the pinion towards an end of the rotatable element located on the side of the ring gear.

* * * * *